US007362660B2

(12) United States Patent
Hildebrandt

(10) Patent No.: US 7,362,660 B2
(45) Date of Patent: Apr. 22, 2008

(54) ADD-ON MEDICINE DISPENSER TIMER

(75) Inventor: William K. Hildebrandt, Inman, SC (US)

(73) Assignee: Add-On Timer, LLC, Spartanburg, SC (US)

( * ) Notice: Subject to any disclaimer, the term of this patent is extended or adjusted under 35 U.S.C. 154(b) by 525 days.

(21) Appl. No.: 11/036,942

(22) Filed: Jan. 14, 2005

(65) Prior Publication Data

US 2005/0121407 A1 Jun. 9, 2005

(51) Int. Cl.
*G04B 47/00* (2006.01)
*B65D 51/16* (2006.01)
*G07F 11/00* (2006.01)

(52) U.S. Cl. ..... 368/10; 215/228; 215/230; 221/2; 221/15

(58) Field of Classification Search ..... 221/2, 221/3, 15; 222/638, 639; 340/309.15, 309.16, 340/309.7–309.9; 215/200, 228, 230, 231
See application file for complete search history.

(56) References Cited

U.S. PATENT DOCUMENTS 4,419,016 A 12/1983 Zoltan
4,849,948 A 7/1989 Davis et al.
4,939,705 A 7/1990 Hamilton et al.
5,016,230 A * 5/1991 Seifers et al. ..... 368/10
5,233,571 A 8/1993 Wirtschafter
5,313,439 A * 5/1994 Albeck ..... 368/10
5,625,334 A 4/1997 Compton
5,751,660 A 5/1998 Chappell
5,751,661 A 5/1998 Walters
5,852,590 A 12/1998 de la Huerga
6,158,613 A * 12/2000 Novosel et al. ..... 221/3
6,229,431 B1 * 5/2001 Weiner ..... 340/309.7
6,317,390 B1 * 11/2001 Cardoza ..... 368/10
6,324,123 B1 11/2001 Durso
6,633,796 B1 10/2003 Pool et al.
6,710,703 B2 3/2004 Huang

* cited by examiner

*Primary Examiner*—Vit W Miska

(57) ABSTRACT

An improved device for timely medication administration that attaches to any original container cap and that measures and displays elapsed time in response to opening or closing of said original container cap is disclosed. Physical, chemical and labeled characteristics of the original medication vessel are thus preserved as dispensed. This device includes a timing unit, a compression reset switch and a thermoplastic housing for the above with a resilient, flexible, circumferential wall that permits operation of the enclosed compression reset switch. The thermoplastic housing also features a rigid lower lip that allows adhesive attachment to the original lid.

20 Claims, 8 Drawing Sheets

ADD-ON MEDICINE DISPENSER TIMER

BACKGROUND OF THE INVENTION

The present invention relates generally to timer devices for medicine dispensers which provide a correct time that a dosage needs to be taken by an individual, and more particularly to a medicine dispenser timer which can be added to an existing medical vial, such as a prescription vial or bottle as originally filled by a pharmacy, or an original non-prescription medicine container, wherein the timer is activated by opening or closing the medicine vial and displays an indication of the next correct dosage on the medicine container cap.

Medication administration errors are well documented in pharmacy and medical literature. Many administration errors are due to inappropriate time intervals of given doses. The result is either overdosing and toxicity, or under dosing causing a sub-therapeutic drug blood level. There are solutions to this dosage interval problem in prior art, but with several problems. These problems are divided into four general areas.

First are the devices that require redistribution of medication from the original container, as dispensed from the pharmacy, distributor, or manufacturer. These devices may result in errors during redistribution, loss of original labeling, and loss of physical and chemical properties protected in the original container.

Second, many devices replace the original container lid. This again may alter the physical and chemical properties of the original container. Replacement of the original container lid also necessitates the device be manufactured in a vast array of configurations and sizes to be useful with the large variety of containers currently in the marketplace.

Third, liquid dosage forms present problems for current devices as the closures are different than those found on containers of solid dosage forms. Liquid dosage forms cannot readily be redistributed into compartmental type devices.

Fourth, many devices and systems require programming or record keeping. Programming can be difficult for patients who are disabled or elderly. Multiple medications can complicate programming requirements and multiple caregivers can add to problems with devices that are difficult to use.

Examples of the above prior art devices are shown in U.S. Pat. Nos. 4,419,016, 4,939,705, 5,233,571, and 5,751,660, as well as the exemplary prior devices described therein. U.S. Pat. No. 4,419,016 discloses a device for indicating last mediation usage which includes a container with a screw on cap which uses a compression switch to indicate the time when the container was last opened to remove a dosage of medication or to display the time elapsed since the cap was last taken off of the container. The cap is said to fit standard vials or containers. Variations of a compression switch are disclosed, such as a pliable extension which is inserted between the cap threads and the bottle neck threads so that as the cap is threaded on the neck, the pliable extension is compressed and contacts within the extension are actuated. U.S. Pat. No. 4,939,705 discloses a container and cap combination wherein a timing device in the cap measures a time interval between when a cap is removed and when the cap is reinstalled to determine a true medical dose access event and distinguish them from false events. In addition, the dispensing container would require redistribution of medicine from the original containers presently used by pharmacies. U.S. Pat. No. 5,233,571 discloses a medication timer having a timing-alarm unit activated by a compression switch which also requires the manufacture of a special medicine cap which would have to replace the standard pharmaceutical cap containers used by pharmacies, or would require a new cap/container combination and redistribution of the medication from the original container. U.S. Pat. No. 5,751,660 discloses a base timer device to which a typical pharmaceutical cap and vial may be attached. The vial may be removed from the base and discarded when empty. The base includes a push button that needs to be actuated by a patient to set the time at which the medication was taken. There appears not to be any correlation between the cap opening and the actuation of the push button so that reliability is compromised.

The goals of the present invention are therefore to provide a device for the timely administration of medication that does not require the redistribution of medications from the original container and does not require replacement of the original container lid. The device should be compatible with all types of child safety and other security closures found on both solid and liquid dosage forms of both prescription and over-the-counter medications. Additionally, the device should be simple to use and not require programming or initial set-up, other than the affixation to an existing container lid. Further goals are to provide a device that is compact, inexpensive to manufacture, and reliable.

SUMMARY OF THE INVENTION

The above objectives are provided by an add-on medicine dispensing timer which can be affixed to an original medicine vial containing a solid or liquid medicine and having a closure cap. The dispensing timer includes a timer housing having an upper wall; a circumferential wall integral with the upper wall, and a lower attachment surface extending from the circumferential housing wall generally parallel to the upper wall for attaching to the cap of the medicine vial. A timing mechanism is carried by the housing which is displaceable relative to at least the circumferential housing wall so that downward force on one of the upper wall and timing mechanism causes the timing mechanism to be reset and actuated to indicate the instantaneous time elapsed since the timing mechanism was reset. Preferably, the circumferential wall of the timer housing includes a circumferential wall that flexes when the downward force is exerted upon the upper wall of the housing to deflect the timing mechanism downward so that the compression switch is engaged by one of the vial cap and lower attachment surface of the housing whereby the timing mechanism is reset and actuated. Advantageously, the lower attachment surface may include a circumferential attachment lip which extends inwardly toward but terminates short of the timing mechanism. The attachment lip is constructed and arranged for attachment to the vial cap whereby the compression switch engages the vial cap to be reset and actuated. The flexible, circumferential wall may include a first wall portion and a second wall portion, the first and second wall portions flexing about a flex point or line so that the upper wall and timing mechanism are displaced downwardly toward the vial cap when pressed when manually removing or replacing the cap. In the case of a typical safety cap, the cap is pushed downward to remove the cap and the timing mechanism is reset. In the case of a non-safety cap, the cap is usually snapped or screwed on with a downward force when the cap is replaced resetting the timing mechanism.

An adhesive layer may be carried by the attachment lip for affixing the attachment lip to the vial cap. The upper wall of the housing includes a retention aperture in which the timing mechanism is pressed and retained. The timing mechanism includes a digital readout seen through the aperture for displaying the time since the vial or bottle cap was reset. This device for timely medication administration will be used with the medication container caps commonly found on prescription and over-the-counter medication containers.

To one commercial form, the device may be generally a chronometer that indicates the length of time the lid has been in place on the medication vessel. The downward pressure of opening or closing the lid acts as the start button on a stopwatch. The digital readout indicates elapsed hours and minutes of lid closure. Simple inspection of the readout allows the consumer to make an informed decision as to whether or not an additional dose of medication is appropriate according to labeled instructions. The device is electrically powered from a battery source.

A primary feature of the invention is that medications require no redistribution from the original dispensing container. The device can be manufactured in several sizes to be used with the lids of common medication vessels, including liquids.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
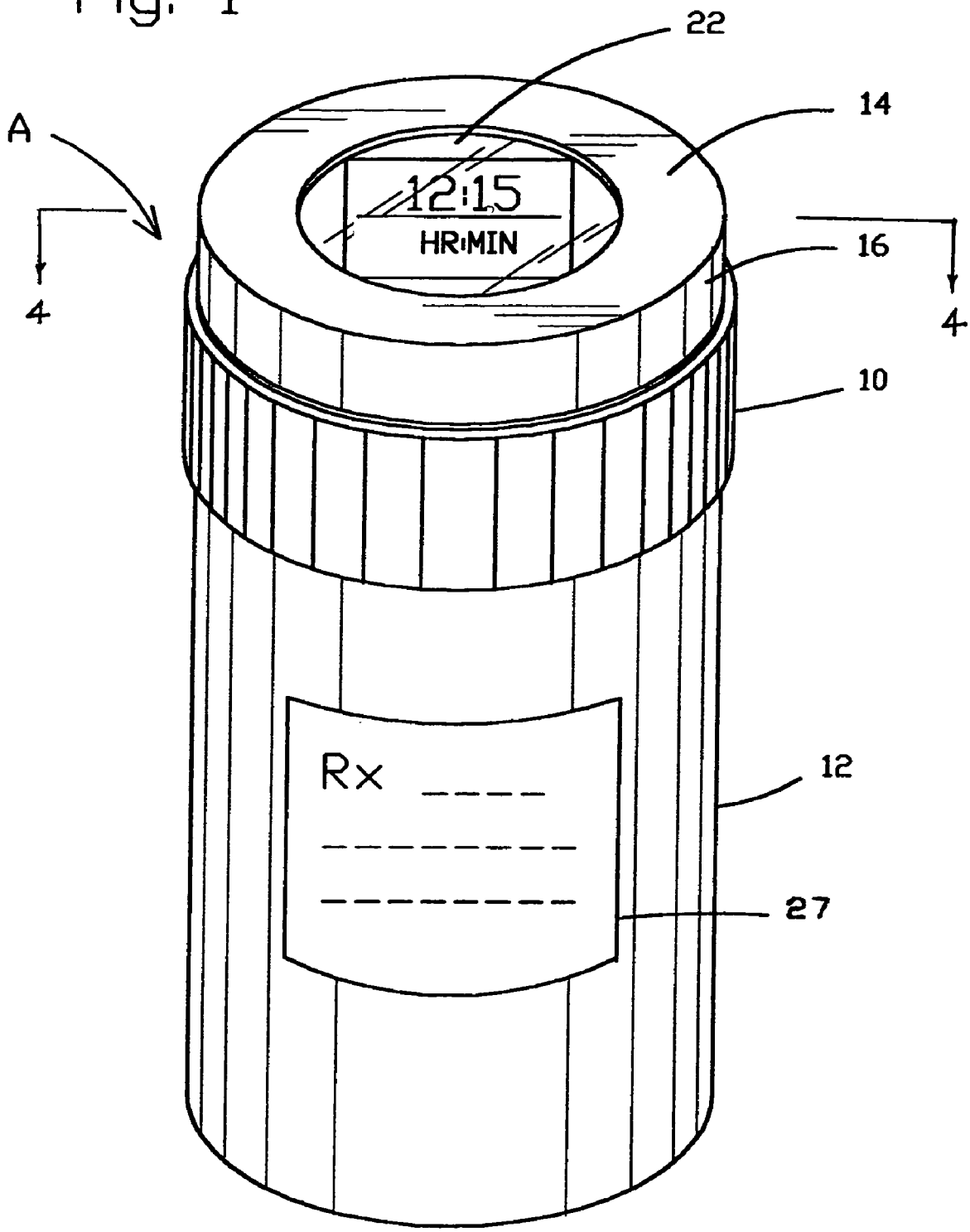
FIG. 1 is a perspective view of a standard pharmaceutical medicine vial incorporating an add-on medicine dispensing timer according to the invention.

Referring now to the drawings, the invention will now be described in more detail.

As can best be seen in FIG. 1, an add-on medicine dispensing timer, designated generally as A, is illustrated as affixed to a standard vial cap 10 of a standard pharmaceutical medicine vial 12 containing a solid or liquid medicine. Since the construction and features of the present invention do not depend on the type of medicine vial, bottle, or other container, prescription or non-prescription, with which the invention may be used, only so much of a cap and vial will be described as is necessary to an understanding of the present invention. Typically, medicine vials with child safety features require that the cap be pushed down on the top of the vial before the cap can be rotated. Medicine vials without child safety features require that the cap be pushed down to close the vial. The present invention is intended to be used with any medicine vial and cap which require downward force on the cap in order to open or close the vial. It being understood, of course, that the term "vial" is used to mean any container having a cap requiring compression to open or close the container.

Figure 2:
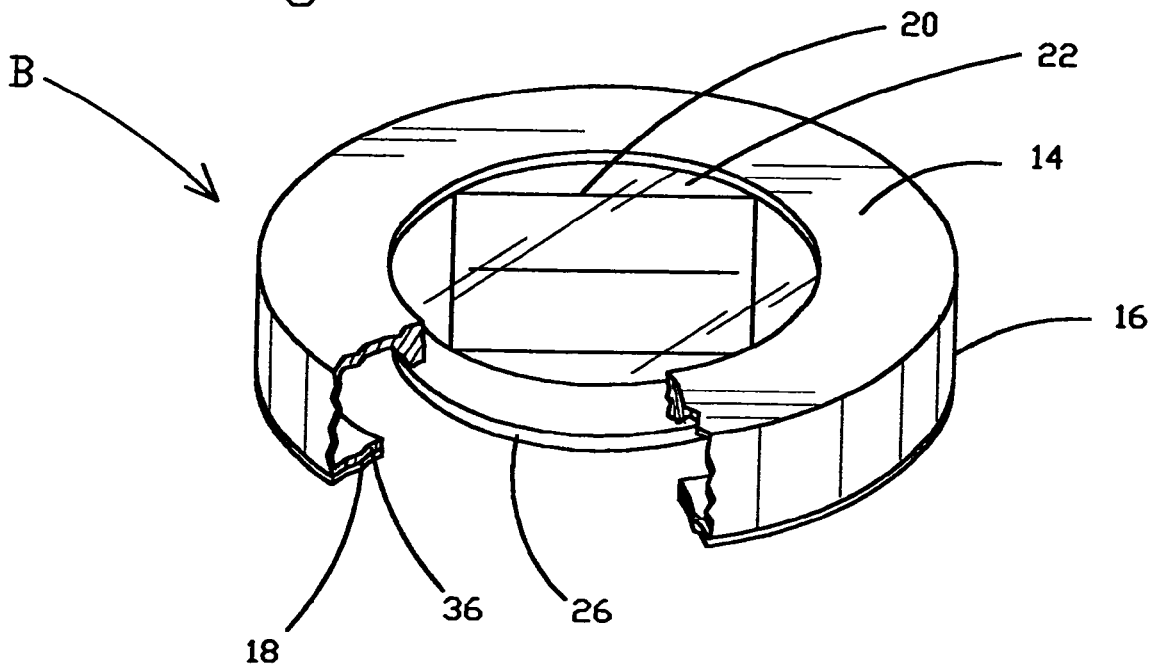
FIG. 2 is a perspective view of an add-on medicine dispensing timer constructed according to the invention with parts cut away.
Figure 3:
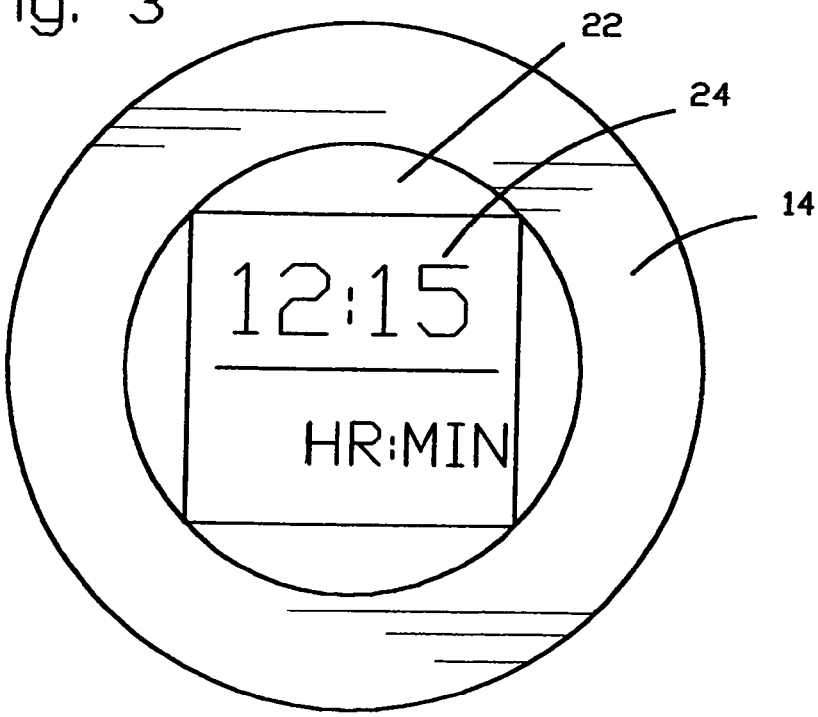
FIG. 3 is a top plan view of the add-on medicine dispensing timer of the present invention.
Figure 4:
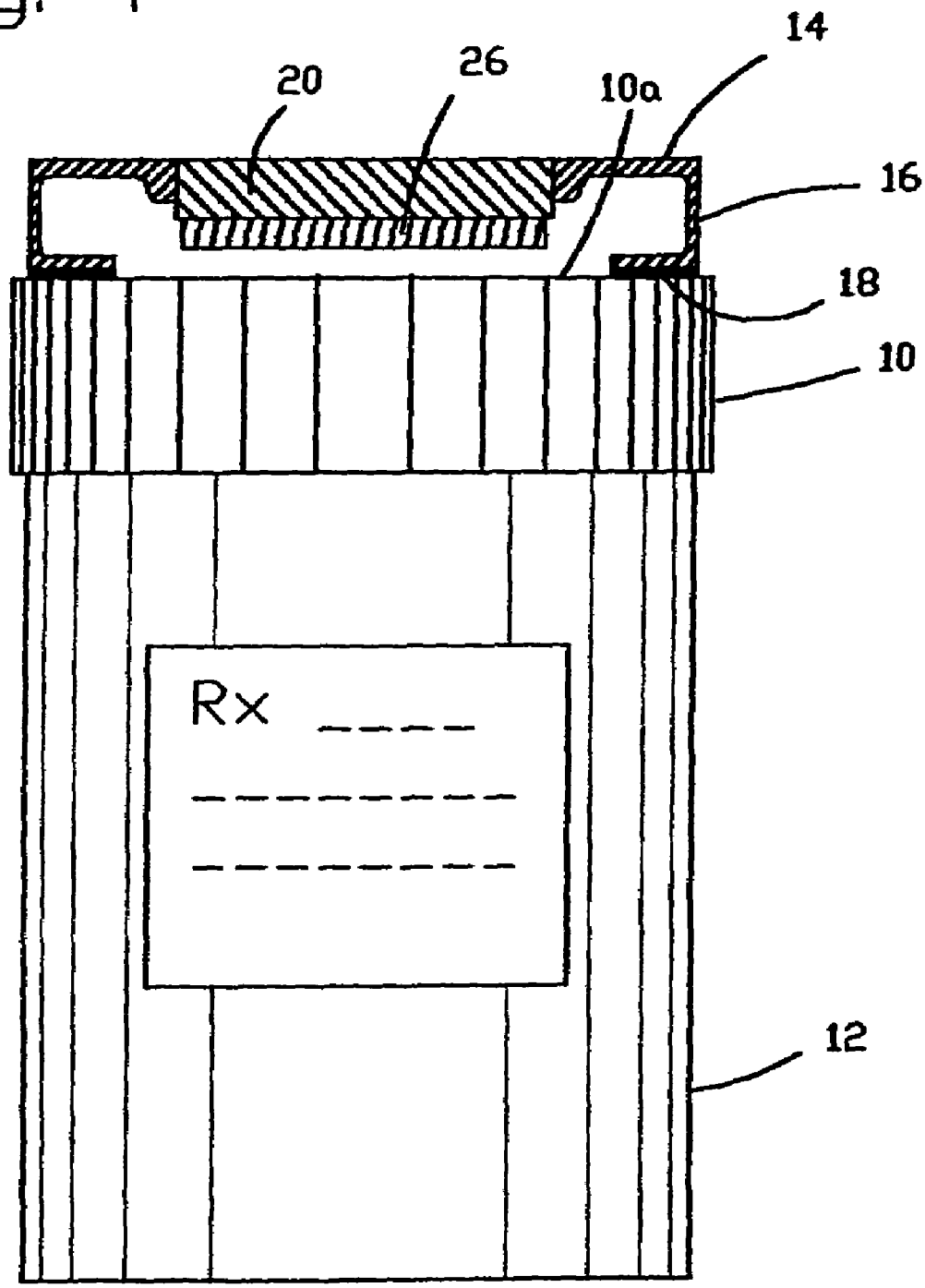
FIG. 4 is a front elevation illustrating a standard pharmaceutical medicine vial and cap with a medicine dispensing timer fixed to the vial cap according to the invention shown in cross-section taken along line 4-4 of FIG. 1 and wherein the timer is in a non-compressed, non-actuated position.
Figure 5:
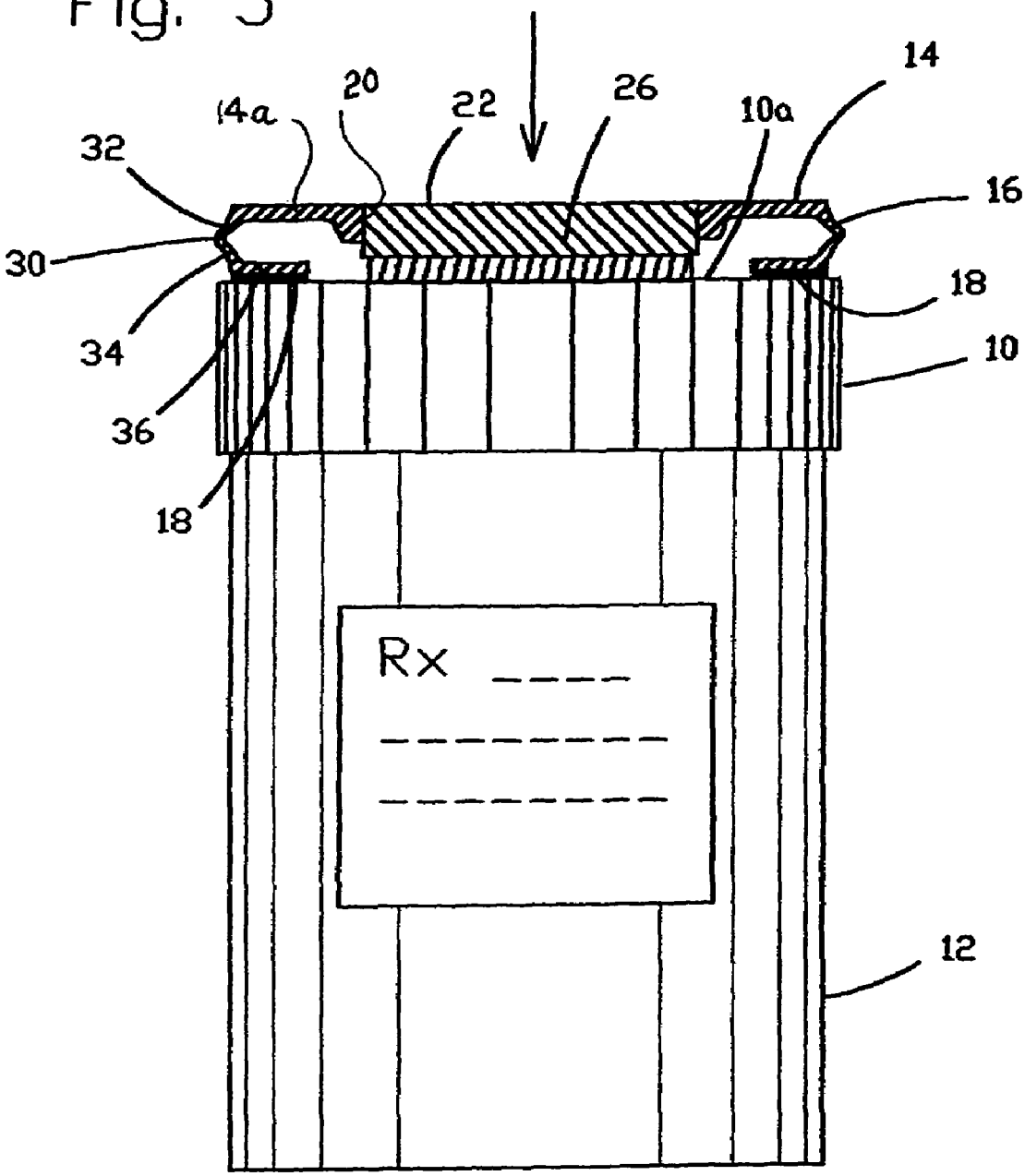
FIG. 5 is a front elevation of a standard pharmaceutical medicine vial and cap having a medicine dispensing timer affixed to the vial cap according to the invention shown in cross-section taken along line 4-4 of FIG. 1 wherein the medicine timer device is in a compressed actuated position for resetting the timing device.
Figure 6:
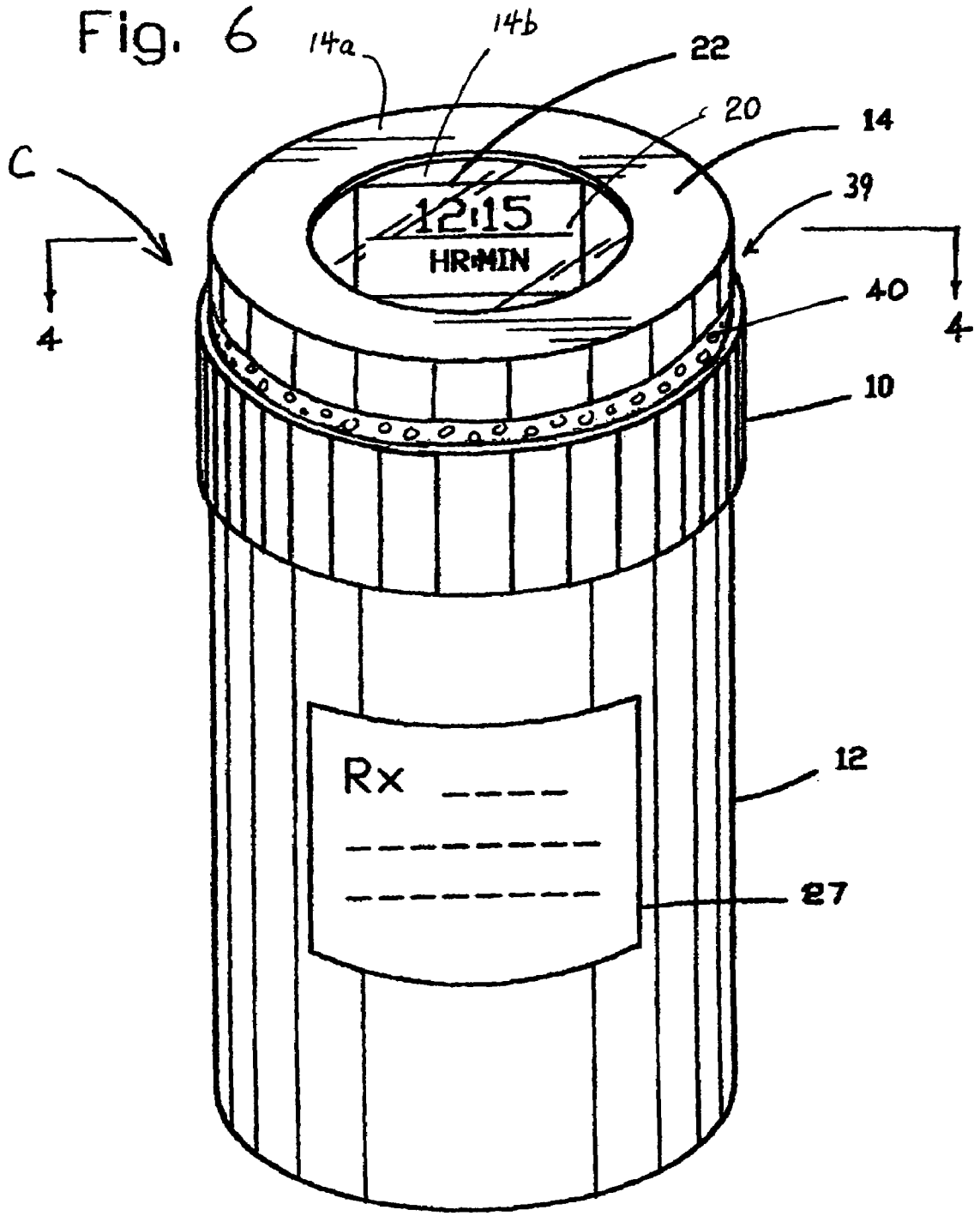
FIG. 6 is a front perspective view of a standard pharmaceutical medicine vial incorporating an add-on medicine dispensing timer according to another embodiment of the invention.
Figure 7:
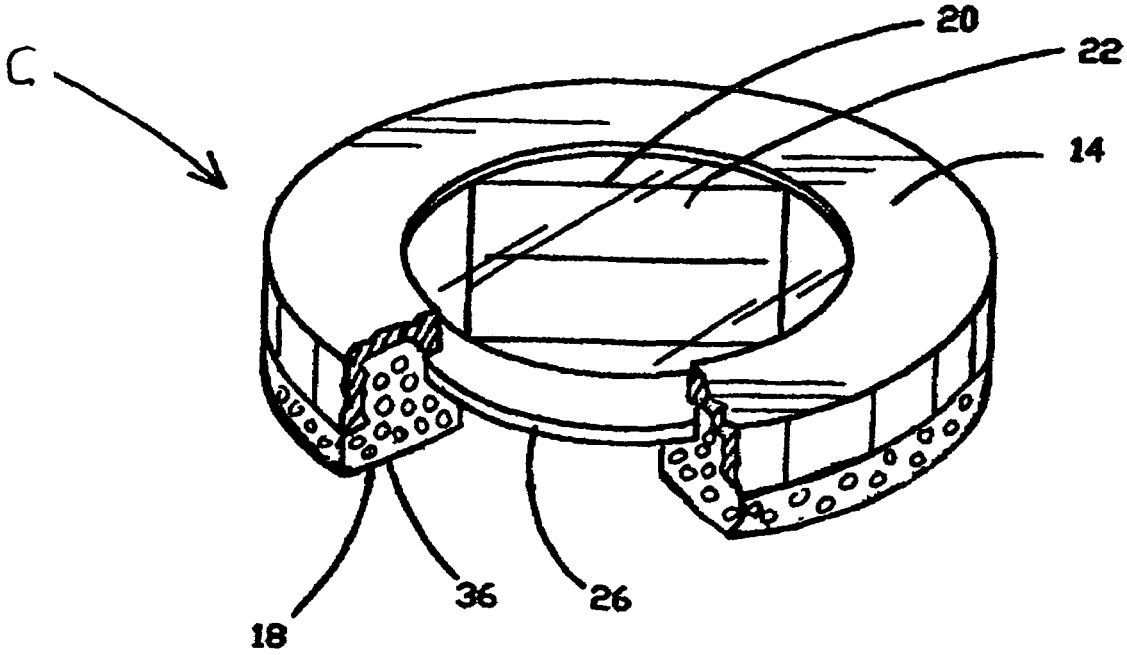
FIG. 7 is a front perspective view of the add-on medicine dispensing timer of FIG. 6 with part of the cap housing cut away.
Figure 8:
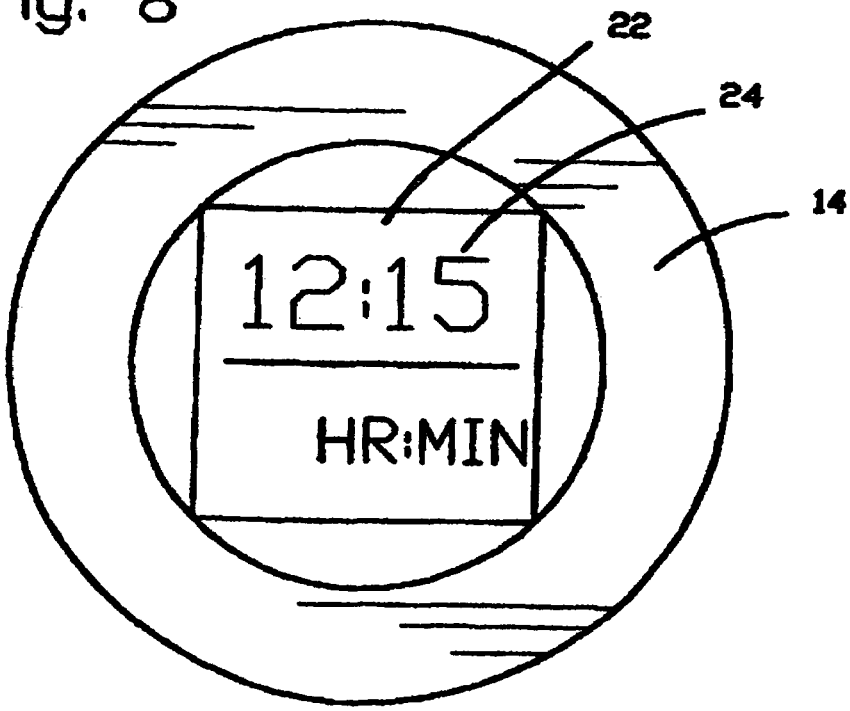
FIG. 8 is a top plan view of the add-on medicine dispensing timer of FIG. 7.

As can best be seen in FIGS. 2 and 3, medicine dispensing timer A includes a timer housing, designated generally as B, preferably formed from a suitable thermoplastic. Timer housing B has a generally rigid upper wall 14 with a generally rigid portion 14*a*, and a generally flexible circumferential sidewall 16 which terminates in a generally rigid attachment lip 18 which affixes to a top surface 10*a* of vial cap 10 (FIG. 5). Upper wall 14 of cap housing B includes a retention aperture 20 for retaining a timing mechanism 22 which is pressed into the aperture and forms an integral part of medicine dispensing timer A when affixed to vial cap 10. Timing mechanism 22 may be any suitable timing mechanism and includes a battery power source. Suitable timing mechanism are disclosed and discussed in U.S. Pat. No. 5,233,571, incorporated in this disclosure by reference. Preferably, the timing mechanism is a simple chronometer that indicates the length of time which has lapsed since when the cap was replaced on the medicine vial after removal for a dosage, without or with an alarm. The mechanism includes a compression switch 26 actuated by the downward pressure on vial cap 10, when opening and closing, to act as a start button on a stopwatch. The mechanism is equipped with a digital readout 24 indicating elapsed time, such as hours and minutes, of cap closure (FIG. 3). A simple inspection of the readout face allows the consumer to make an informed decision as to whether or not a dose of medication is required according to the pharmacy label instructions 27. As can best be seen in FIGS. 4 and 5, a compression reset switch 26 of timing mechanism 22 may be provided on the bottom of the timing mechanism so that the compression switch is actuated by a downward force and compression of housing B. For this purpose, circumferential wall 16 of housing B may be constructed as a resilient, flexible, circumferential wall that deform outwardly when downward force is applied to the upper wall 14, as indicated in FIG. 5. Flexible, circumferential wall 16 may include a flex line 30 about which the wall flexes so that a first wall portion 32 and a second wall portion 34 are made to be inclined with respect to one another rather than co-parallel. Resilient, flexible, circumferential wall 16 is in a non-compressed state in FIG. 4. Means for affixing housing B to vial cap 10 may include a circumferential adhesive strip or adhesive layer 36 carried by attachment lip 18 of housing B. Other suitable means for affixing the timer housing to the vial cap may also be utilized. For example, a compressible housing constructed from a cellular foam material, such as neoprene, may be used. In this case, the compressible housing may be washer shaped with the timing mechanism embedded therein or thereon. For purpose of the above illustrated construction upper wall 14 may be rigid, attachment lip 18 may be rigid, and circumferential wall 16 may be flexible so that downward force on upper surface 14, or the timing mechanism, causes timing mechanism 22 to move downward so that compression switch 26 engages upper surface 10*a* of cap 10. When reset switch 26 is actuated, the timer is reset either on opening or closing, or both. Whether the timer is reset upon opening or closing, the display will effectively indicate the time elapsed since cap closure and last dosage of the medicine. While medicine dispensing timer A is shown affixed on a tablet or other dry medicine vial, it is understood, of course, that the timer can also be used on original liquid medicine containers and vials. For that purpose, timer housing B may be made in various sizes to fit on various caps of original medicine containers and vials.

Referring now to FIGS. 6 through 10, another embodiment of a add-on medicine dispensing timer, designated generally as C, will be described. A standard medicine vial 12 having a standard vial cap 10 is provided with add-on medicine dispensing timer. The dispensing timer includes a cap housing, designated generally as 39, which includes an upper cap wall 14. Cap wall 14 includes a generally rigid portion 14*a* and a display portion 14*b* through which a timer display may be viewed. The timer mechanism 22 is disposed below the upper cap wall which has a time display 24 that is viewable through the display portion of the upper cap wall. A deformable element 40 is disposed below the upper cap wall so that a downward force on the upper cap wall causes rigid portion 14*a* to deform deformable element 40. For this purpose, element 40 may be any suitable compressible, deformable, resilient structure which supports the upper cap wall in a non-actuated position but allows the upper cap wall to move downward for actuation of compression switch 26. Element 40 may be a solid disk, an annular disk, or individual spaced elements. A lower attachment surface 18 is provided for affixing the cap housing to the vial cap 10. In the illustrated embodiment, the lower attachment surface may be the surface of deformable element 40 bearing against the top of the vial cap 10. As it is in the embodiment of FIGS. 1 through 5, timer mechanism 22 is started and stopped by actuation of reset switch 26. The standard vial cap requires a certain amount of pressure to open and close the vial cap. In accordance with the present invention, reset switch 26 is actuated by a downward, timer reset pressure created by exerting a downward force on the upper cap wall, particularly rigid portion 14*a*, and deformation of deformable element 40. The timer reset pressure is slightly less than, i.e. less than or equal to, the opening or closure pressure for the vial cap so that the timer mechanism is automatically reset upon closure of the vial cap. Even if the timer mechanism is reset upon opening of the vial cap, it will again be reset when the vial cap is placed on the medicine vial and closed so that the elapsed time since closure is shown in the timer display. In this manner, the patient can tell how long it has been since medicine was last dispensed from the vial and can regulate their dosage accordingly.

Figure 9:
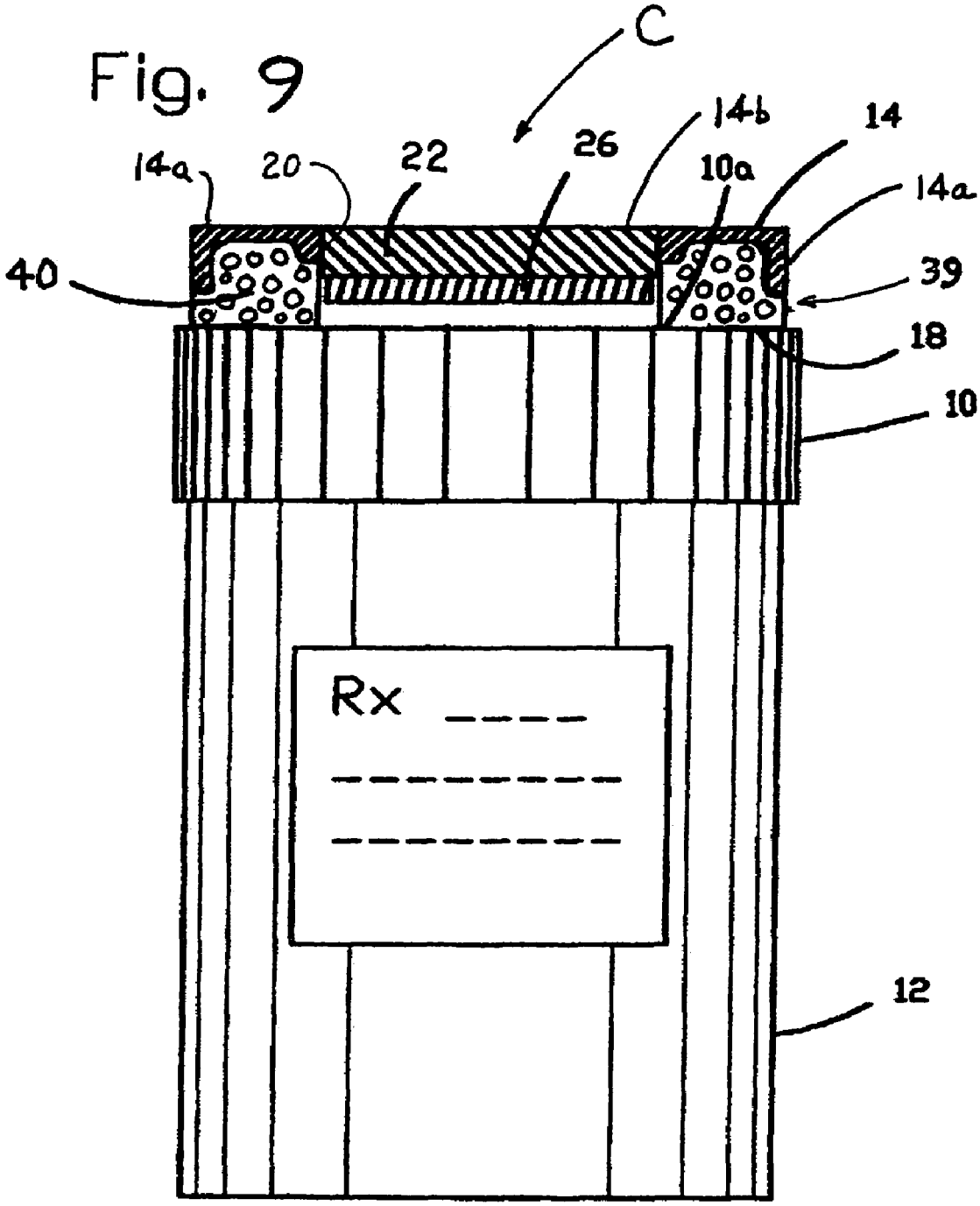
FIG. 9 is a front elevation illustrating a standard medicine vial and vial cap with the medicine dispensing timer fixed to the vial cap according to the invention with the timer cap being shown in cross-section, and wherein the timer cap is in a non-actuated position.
Figure 10:
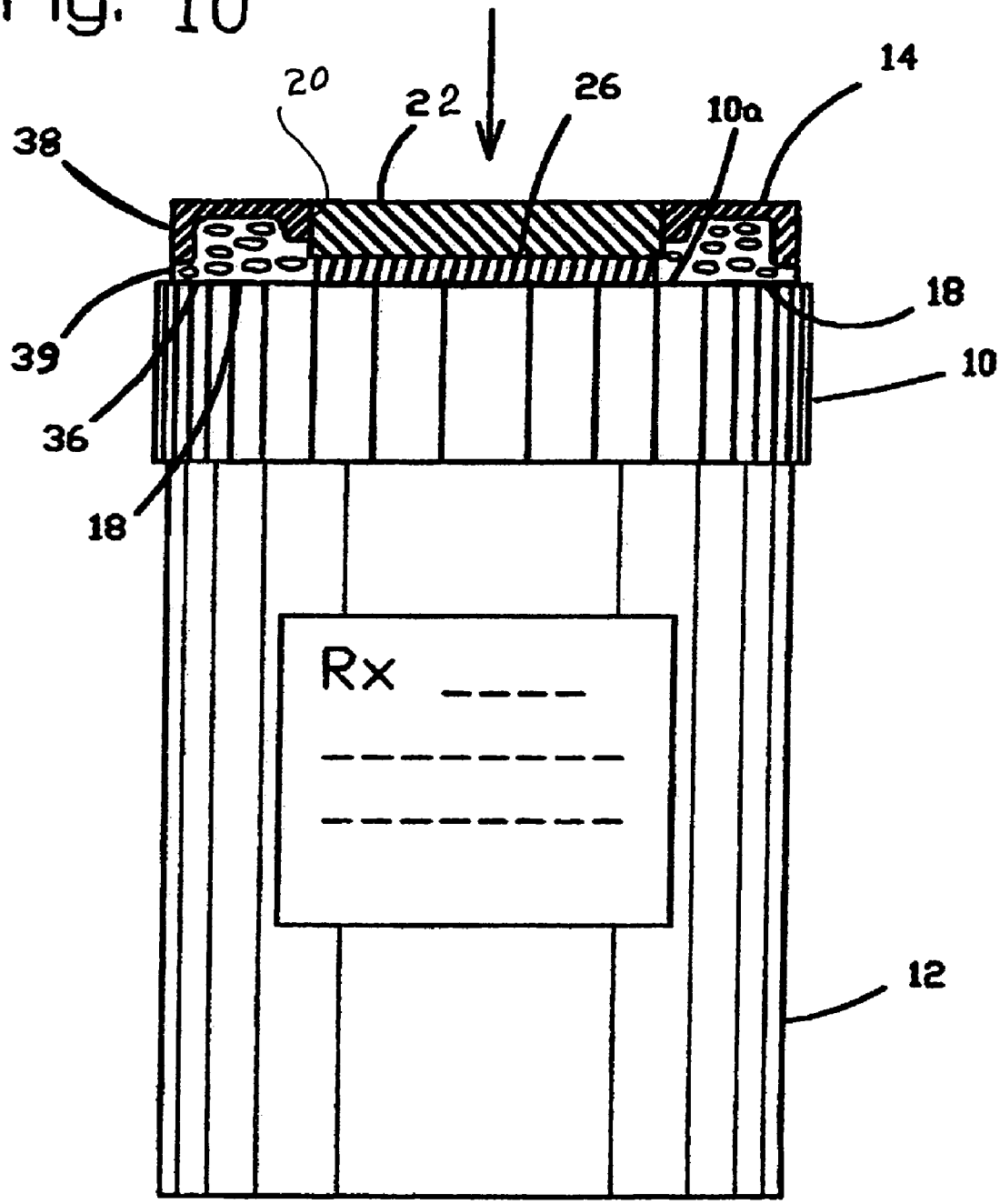
FIG. 10 is a front elevation of a medicine vial and timer cap fixed to the vial cap of the standard medicine vial with the timer cap shown in cross-section wherein the timer cap is in a reset position due to the downward force on the timer cap.

As can best be seen in FIG. 9, normally the dispensing timer is in a non-actuated position wherein reset switch 26 is out of contact with vial cap 10. Upon the exertion of a sufficient force to open the vial cap, as indicated by arrow 42, the reset pressure is achieved automatically when the vial cap is removed (FIG. 10). Likewise, when the timer cap and vial cap are placed in a closed position on the medicine vial, the reset switch is likewise actuated as shown in FIG. 10. While the timer mechanism and reset switch are shown carried by upper cap wall 14, it is to be understood, of course, that the timer unit may also be carried within cap housing 39 so that the timer mechanism is stationary and a movement of cap wall 14 downward activates the compression switch. In other words, the upper cap wall 14 need only have relative movement with respect to the vial cap 10 to actuate compression switch 26.

Thus, it can be seen that an advantageous construction can be had according to the invention for a medicine dispensing timer which can be added to any original medicine container with the original dosage instruction attached. The timing mechanism, such as a chronometer, is reset by the downward pressure required to either open or close the lid. In the case of a child safety cap the reset occurs upon opening. In the case of a non-child safety cap the reset occurs upon closure. Visual inspection of the display indicates proper reset of the device. In the event that opening or closing has not resulted in proper reset of the device, the device can be reset by downward pressure until the display has been reset to zero. In this case, the device resets at a time close enough in proximity to the administration of the removed dose of medication that the displayed time will be useful in determining if the next dose of medication is indicated according to labeled instruction.

While a preferred embodiment of the invention has been described using specific terms, such description is for illustrative purposes only, and it is to be understood that changes and variations may be made without departing from the spirit or scope of the following claims.

What is claimed is:

1. An add-on medicine dispensing timer cap which can be affixed to an original medicine vial having a vial closure cap comprising:

a timer cap housing having an upper cap wall with an upper rigid portion;

a circumferential wall integral with said upper wall having a lower deformable portion;

a lower attachment surface integral with said lower deformable portion for attaching said cap housing to the vial cap of the medicine vial; and a timing mechanism carried by said housing and being displaceable relative to said vial cap in a manner that downward force on said rigid portion of said upper wall causes said timing mechanism to be reset and actuated to indicate the instantaneous time elapsed since said timing mechanism was last reset.

2. The device of claim 1 wherein said lower deformable portion of said circumferential wall includes a circumferential wall that flexes when said downward force is exerted upon said upper wall of said housing to deflect said timing mechanism downward so that said compression switch is engaged by one of said vial cap and lower attachment surface of said housing whereby said timing mechanism is reset and actuated.

3. The device of claim 2 wherein said lower attachment surface includes a circumferential attachment surface which extends inwardly from said circumferential wall attachment to said vial cap.

4. The device of claim 3 wherein said attachment surface includes an adhesive layer.

5. The device of claim 2 wherein said flexible, circumferential wall includes a first wall portion and a second wall portion, said first and second wall portions flexing about a flex line so that said upper wall and timing mechanism are displaced downwardly in the direction of said vial cap when pressed upon manually to remove or replace the cap.

6. The device of claim 1 wherein said upper cap wall includes a display portion for viewing a digital readout of said timing mechanism.

7. An add-on medicine dispensing timer cap which can be affixed to an original medicine vial having a vial cap wherein opening and closing of said vial cap on said vial requires a downward vial cap pressure on said vial cap, said timer cap comprising:

a cap housing;

an upper cap wall having a display portion and an upper rigid portion;

a timer mechanism disposed below said upper wall having a time display viewable through said display portion of said upper wall;

a deformable element disposed below said upper wall;

a lower attachment surface for affixing said cap housing to said vial cap;

said timer mechanism having a reset switch actuated by timer reset pressure exerted on said switch through a downward force on said rigid portion of said upper cap wall and resulting deformation of said deformable element; and said timer reset pressure being generally less than or equal to said vial cap closure pressure so that said timer mechanism is automatically reset upon closure of said vial cap.

8. The device of claim 7, wherein the deformable element is a cellular foam material.

9. The device of claim 7, wherein the lower attachment surface is the bottom of the deformable element and is adapted to attach the cap housing to an upper surface of the vial cap.

10. An add-on timer for a medicine vial having a closure cap, comprising:

(a) a timer housing, having (i) a rigid upper wall, and (ii) a flexible, circumferential wall, attached to the upper wall, wherein the circumferential wall has a lower attachment surface for attaching the housing to the closure cap, and the circumferential wall is sufficiently flexible to allow relative displacement of the upper wall of the housing toward the closure cap, when downward force is applied to the housing;

(b) a timing mechanism, attached to the upper wall of the housing, having (i) means for measuring elapsed time; (ii) a digital readout to display elapsed time; (iii) a battery; and (iv) a compression switch, wherein the compression switch is positioned to be actuated by displacement of the upper wall of the housing relative to the closure cap; and (c) a means to attach the lower attachment surface of the circumferential wall to the closure cap.

11. The add-on timer of claim 10, wherein the lower attachment surface of the circumferential wall is adapted to attach the housing to the upper surface of the closure cap.

12. The add-on timer of claim 11 wherein the compression switch is positioned on a bottom side of the timing mechanism, and the compression switch is actuated by engaging the upper surface of the closure cap, when the upper wall of the housing is displaced downward.

13. The add-on timer of claim 10, wherein the lower attachment surface of the circumferential wall is a lip, and the means to attach the lower attachment surface of the circumferential wall to the closure cap is an adhesive applied to the lip.

14. The add-on timer of claim 10, wherein the flexible circumferential wall is resilient, and the housing returns to a non-compressed state, when downward force is removed.

15. The add-on timer of claim 10, wherein the circumferential wall is a cellular foam material.

16. The add-on timer of claim 10, wherein the circumferential wall flexes when downward force is applied to the housing.

17. The add-on timer of claim 10, wherein the circumferential wall deforms when downward force is applied to the housing, and the circumferential wall returns to a non-compressed state when downward force is removed.

18. The add-on timer of claim 10, wherein the circumferential wall is comprised of individual spaced elements constructed of a deformable and resilient material.

19. An add-on timer for a medicine vial having a closure cap, comprising:

(a) a timer housing, having (i) an upper wall, and (ii) a flexible, circumferential wall, attached to the upper wall, wherein the circumferential wall has a lower attachment surface for attaching the housing to the closure cap, and the circumferential wall is sufficiently flexible to allow relative displacement of the upper wall of the housing toward the closure cap, when downward force is applied to the housing, and wherein the circumferential wall further comprises a first wall portion and a second wall portion, which are separated by a flex line, and the first and second wall portions incline and flex outward when downward force is applied to the housing;

(b) a timing mechanism, attached to the upper wall of the housing, having (i) means for measuring elapsed time; (ii) a digital readout to display elapsed time; (iii) a battery; and (iv) a compression switch, wherein the compression switch is positioned to be actuated by displacement of the upper wall of the housing relative to the closure cap; and (c) a means to attach the lower attachment surface of the circumferential wall to the closure cap.

20. The add-on timer of claim 19, wherein the upper wall of the housing is rigid.

* * * * *